US011085177B2

(12) United States Patent
Schurle et al.

(10) Patent No.: US 11,085,177 B2
(45) Date of Patent: Aug. 10, 2021

(54) SANITARY UNIT

(71) Applicant: Neoperl GmbH, Mullheim (DE)

(72) Inventors: Holger Schurle, Mullheim (DE); Dietmar Walser, Efringen-Kirchen (DE); Alexander Stein, Ihringen (DE)

(73) Assignee: Neoperl GmbH, Müllheim (DE)

( * ) Notice: Subject to any disclaimer, the term of this patent is extended or adjusted under 35 U.S.C. 154(b) by 12 days.

(21) Appl. No.: 16/308,159

(22) PCT Filed: Sep. 15, 2017

(86) PCT No.: PCT/EP2017/001093
§ 371 (c)(1),
(2) Date: Dec. 7, 2018

(87) PCT Pub. No.: WO2018/050285
PCT Pub. Date: Mar. 22, 2018

(65) Prior Publication Data

US 2019/0301148 A1 Oct. 3, 2019

(30) Foreign Application Priority Data

Sep. 16, 2016 (DE) ..... 102016011168.2

(51) Int. Cl.
*E03C 1/08* (2006.01)
*B05B 1/30* (2006.01)
(Continued)

(52) U.S. Cl.
CPC ..... *E03C 1/084* (2013.01); *B05B 1/30* (2013.01); *B05B 1/3046* (2013.01);
(Continued)

(58) Field of Classification Search
CPC ..... E03C 2001/026; E03C 1/08; E03C 1/084; B05B 1/3402; B05B 1/3013; B05B 1/30; B05B 1/3046; B05B 12/002
(Continued)

(56) References Cited

U.S. PATENT DOCUMENTS 2,954,936 A * 10/1960 Shames ..... F16L 37/48 239/428.5
3,061,199 A * 10/1962 Billeter ..... B05B 1/3006 239/109
(Continued)

FOREIGN PATENT DOCUMENTS

DE 3006660 8/1981
DE 3643320 7/1988
(Continued)

*Primary Examiner* — Joseph A Greenlund
(74) *Attorney, Agent, or Firm* — Volpe Koenig

(57) ABSTRACT

A sanitary unit (1, 116, 118) is provided which has a sleeve-shaped outlet mouthpiece (2), which (2) can be installed on a water outlet of a sanitary outlet fitting and has a sleeve interior, into which is inserted a sanitary functional unit (5) with at least one functional element (5), which (5) has a component (6), which (6) can be adjusted between at least two functional positions, by an externally accessible handle, via a transmission element (9) which is guided in an axially displaceable manner in the functional element (5). The handle is configured in the form of an actuating element (7) which is retained in a displaceable manner on the outer circumference of a sub-region, forming part of the outlet mouthpiece (2), which projects beyond the water outlet of the outlet fitting, and the actuating element (7), which serves as a handle has a water-jet-permeable or water-jet-guiding outlet structure (8) held on it that connects the actuating element (7) to the transmission element (9).

27 Claims, 11 Drawing Sheets

(51) Int. Cl.
*B05B 1/34* (2006.01)
*E03C 1/084* (2006.01)
*B05B 12/00* (2018.01)

(52) U.S. Cl.
CPC ..... *B05B 1/3402* (2018.08); *B05B 12/002* (2013.01); *E03C 1/08* (2013.01)

(58) Field of Classification Search
USPC ..... 239/428.5
See application file for complete search history.

(56) References Cited

U.S. PATENT DOCUMENTS 3,334,818 A * 8/1967 Moen ..... E03C 1/084 239/428.5
4,470,546 A * 9/1984 Wildfang ..... E03C 1/084 239/428.5
5,348,231 A * 9/1994 Arnold ..... E03C 1/084 239/428.5
6,357,675 B1 * 3/2002 Schorn ..... B05B 7/0425 239/311
7,431,224 B2 * 10/2008 Laker ..... E03C 1/08 239/533.1
7,594,519 B2 * 9/2009 Hart ..... G05D 7/012 138/43
9,151,026 B2 10/2015 Wildfang
2005/0001064 A1 * 1/2005 Taketomi ..... E03C 1/084 239/461
2005/0247805 A1 * 11/2005 Grether ..... B05B 1/18 239/428.5
2006/0273203 A1 * 12/2006 Denzler ..... E03C 1/04 239/428.5
2009/0224067 A1 * 9/2009 Grether ..... E03C 1/084 239/106
2010/0025612 A1 2/2010 Tasi
2012/0325928 A1 * 12/2012 Gransow ..... B05B 1/16 239/8
2013/0068860 A1 * 3/2013 Tempel ..... B05B 1/3073 239/428.5
2013/0134235 A1 * 5/2013 Blum ..... E03C 1/084 239/428.5
2014/0203107 A1 * 7/2014 Lacher ..... E03C 1/084 239/428.5
2014/0217202 A1 * 8/2014 Stein ..... B05B 1/1609 239/392
2014/0263753 A1 * 9/2014 Bush ..... B05B 7/0425 239/428.5
2014/0300010 A1 * 10/2014 Zhou ..... B05B 7/0425 261/78.2
2015/0353391 A1 * 12/2015 Wang ..... C02F 1/78 210/136
2016/0177553 A1 * 6/2016 Bosio ..... E03C 1/084 239/428.5
2016/0222637 A1 * 8/2016 Stein ..... G05D 7/012
2017/0185090 A1 * 6/2017 Twitchett ..... F16K 31/002
2019/0194918 A1 * 6/2019 Schurle ..... E03C 1/084
2019/0301148 A1 * 10/2019 Schurle ..... E03C 1/084

FOREIGN PATENT DOCUMENTS

DE 3903800 8/1990
DE 102006057795 2/2008
EP 1443151 8/2004
EP 2664719 11/2013
EP 2762234 8/2014
WO 2006094680 9/2006

* cited by examiner

SANITARY UNIT

BACKGROUND

The invention relates to a sanitary unit which has a sleeve-shaped outlet mouthpiece which is capable of being assembled on a water outlet of a sanitary outlet fitting, and has a sleeve interior in which a sanitary functional unit having at least one functional element is inserted, said functional element having a component which by an externally accessible handling element is adjustable between at least two functional positions by way of a transmission element which is guided so as to be axially displaceable in the functional element.

A sanitary unit which is capable of being assembled on the water outlet of a sanitary outlet fitting is already known from WO 2006/094680 A1. The previously known sanitary unit to this end has a sleeve-shaped outlet mouthpiece which by way of an external thread on the external circumference is screw fittable into an internal thread provided in the water outlet. A sanitary functional unit which is comprised of an attachment or filter screen on the inflow side and of a jet regulator that is releasably connectable thereto on the outflow side, said jet regulator intended to form the outflow water to a homogeneous, splash-free and pearly-soft water jet is inserted into the outlet mouthpiece. In order to avoid any unauthorized unscrewing of the outlet mouthpiece from the water outlet of the sanitary outlet fitting, the part-region that projects beyond the water outlet of the outlet fitting is encompassed by an annular sleeve which is secured in the axial direction but is held so as to be freely rotatable in the circumferential direction on the outlet mouthpiece.

A functional unit of the type mentioned at the outset which with the aid of a sleeve-shaped outlet mouthpiece is capable of being assembled on the water outlet of a sanitary outlet fitting and which has a setting installation for varying the available throughflow cross section of the functional unit and/or of the throughput is already known from EP 2 664 719 A. The setting installation is activatable by way of a pin-shaped activation element which is guided so as to be displaceable in the functional unit and can be gripped at a part-region that projects beyond the outlet end side of the functional element. However, it is disadvantageous that the user who wants to adjust the previously known functional element from one functional position to the at least one further functional position has to reach into the water flow without being able to identify the activation element therein.

SUMMARY

Therefore, there is in particular the object of achieving a sanitary unit of the type mentioned at the outset which is distinguished by simplified handling for the user.

The achievement of this object according to the invention in the case of the sanitary unit of the type mentioned at the outset lies in particular in that the handling element is designed as an activation element which is held so as to be displaceable on an external circumference of a part-region of the outlet mouthpiece that projects beyond the water outlet of the outlet fitting, and in that a water-jet-permeable or water-jet-guiding outlet structure which connects the activation element to the transmission element is held on the activation element that serves as a handling element.

The sanitary unit according to the invention has a sleeve-shaped outlet mouthpiece which is capable of being assembled on a water outlet of a sanitary outlet fitting. The sleeve-shaped outlet mouthpiece has a sleeve interior in which a sanitary functional unit that is preferably designed as an insert cartridge having at least one functional element is inserted. The at least one functional element has a component which via an externally accessible handling element is adjustable between at least two functional positions by way of a transmission element which is guided so as to be axially displaceable in the functional element. The handling element herein that is provided for adjusting the component that is provided in the functional element is designed as an activation element and preferably as an annular activation ring, wherein the activation element is held so as to be displaceable on the external circumference of a part-region of the outlet mouthpiece that projects beyond the water outlet of the outlet fitting.

A water-jet-permeable or water-jet-guiding outlet structure that is oriented transversely to the throughflow direction of the functional element is held on the activation element that serves as a handling element, said outlet structure connecting the activation element to the transmission element. Since the activation element thus by way of the outlet structure that is held on the activation element and in particular is molded thereon is connected to the transmission element, the activation element that is located on the external circumference of the outlet mouthpiece can be gripped without the user having to reach into the water flow running out. Due to this, the handling of the sanitary unit according to the invention is substantially facilitated.

A particularly simple embodiment according to the invention provides that the outlet structure is formed by connection webs that are oriented transversely to the outlet direction of the functional element.

By contrast, one preferred refining embodiment according to the invention lies in that the outlet structure is configured as a honeycomb cell structure, a mesh structure, or net structure, which is formed by webs that mutually intersect at intersection points and/or are integrally molded to one another, said webs therebetween delimiting throughflow openings. The water flowing out of the sanitary unit can be particularly readily shaped to a homogeneous and splash-free outlet jet in such a honeycomb-shaped, mesh-shaped, or net-shaped outlet structure. This outlet structure herein is formed by webs that mutually intersect at intersection points and which therebetween delimit water-jet-guiding throughflow openings. The webs that mutually intersect at intersection points can be disposed in a common plane that is oriented transversely to the throughflow direction. However, it is also possible for the webs that therebetween delimit throughflow openings to be integrally molded to one another in mutually adjacent planes.

One preferred embodiment according to the invention provides that the outlet structure is integrally molded to the activation element that serves as the handling element.

It is expedient herein for the outlet structure to form the outflow-side end side of the activation element.

In order for the transmission element that by way of the outlet structure is connected to the activation element to be able to engage in the functional element and to be able to selectively adjust the latter to one of two functional positions, it is advantageous for the transmission element to be molded to the inflow side of the outlet structure and to project counter to the throughflow direction beyond this outlet structure.

One preferred configuration according to the invention in which the outlet structure offers the inflowing water only a comparatively minor degree of resistance and in which the water flowing therethrough can be particularly readily shaped to a homogeneous outlet jet provides that the outlet structure is a honeycomb cell structure from mutually intersecting webs which delimit honeycomb-cell-shaped throughflow openings.

The water flowing from the sanitary unit can be particularly readily shaped to a homogeneous and splash-free waterjet, even when the outflow water has not yet been rectified in the functional element, when the outlet structure is configured as a flow rectifier, and when the throughflow openings of the outlet structure in the throughflow direction have a height h which is larger than the maximum available cross section W of the throughflow openings.

The activation element can be particularly readily displaced on the external circumference of the outlet mouthpiece without a comparatively large play offering resistance thereto between the activation element and the outlet mouthpiece when the activation element is configured so as to be sleeve-shaped and by way of the outlying sleeve circumference thereof bears so as to be displaceable on the external circumference of the outlet mouthpiece.

The guiding in a secure and play-free manner, as well as a tight hold of the activation element that is held on the outlet mouthpiece is facilitated when a guide internal wall projects counter to the throughflow direction beyond the outlet end side of the activation element and when the outflow-side part-region of the circumferential wall of the outlet mouthpiece is guided into the annular space between the outlying sleeve circumference of the activation element and the guide internal wall.

The activation element can be easily displaced on the outlet mouthpiece without the secure hold of the latter on the outlet mouthpiece being impeded as a result, when the outlet mouthpiece on the internal circumference of the circumferential wall thereof has at least one guide groove which extends in the throughflow direction and in which at least one guide groove, an assigned guide protrusion that is disposed on the outlying sleeve circumference of the activation element engages, said at least one guide protrusion interacting with the at least one guide groove in such a manner that said guide groove and said guide protrusion delimit the sliding path of the activation element on the outlet mouthpiece.

The assembly of the sanitary unit according to the invention is substantially facilitated also in the region between the outlet mouthpiece and the activation element when the outlet mouthpiece on the outflow-side end peripheral region on the internal circumference, and the guide internal wall of the activation element on the free end peripheral region thereof on the external circumference have in each case one ramp, said ramps interacting for snap-fitting or latching, respectively, the guide protrusion in the guide groove.

One preferred embodiment according to the invention which is distinguished by a pearly-soft outlet jet, provides that the at least one functional element or one of the functional elements of the functional unit is configured as an aerated jet regulator which mixes the water perfusing the insert housing with ambient air.

In the case of such an aerated jet regulator it can be advantageous for the functional unit that has the aerated jet regulator to have an insert housing, at least one aeration opening for suctioning ambient air into the housing interior of the insert housing being provided on the housing circumference of said insert housing and/or on the outflow-side housing end side of said insert housing.

It can be advantageous for at least one hole to be provided beyond the throughflow openings on the outlet end side of the activation element, said hole being disposed on the circumference in relation to said activation element.

If at least two holes that are mutually spaced apart in the circumferential direction are provided on the outlet end side of the activation element, said holes can form a tool engagement location for a rotating tool that is attachable to the activation element on the end side.

The outlet mouthpiece has an external thread or an internal thread which by way of a counter thread can be assembled on the water outlet of a sanitary outlet fitting. In order then for the outlet mouthpiece to be able to be screwed tightly to the water outlet or to be able to be unscrewed again from the water outlet of the sanitary outlet fitting, and in order for the rotary force required therefor to be transmitted from the activation element to the outlet mouthpiece, it is advantageous for the activation element in at least one sliding position that is advanced counter to the throughflow direction to be able to be connected to the outlet mouthpiece in a rotationally fixed manner.

In order for the activation element to be able to be connected in a rotationally fixed manner to the outlet mouthpiece in the advanced sliding position, one advantageous exemplary embodiment according to the invention provides that the outlet mouthpiece at least in one part-region of the longitudinal extent thereof has a shaping that in at least one circumferential portion deviates from the circular cross section and in particular is configured as a preferably planar sinking, and that the sleeve-shaped activation element on the sleeve internal circumference thereof in at least one portion of the longitudinal extent thereof has at least one protrusion which in the sliding position of the activation element that is advanced counter to the throughflow direction is capable of being moved so as to be congruent with the at least one part-region of the outlet mouthpiece that deviates from the circular cross section.

For the same purpose, one further advantageous embodiment according to the invention provides that at least one anti-rotation protrusion projects on the outlet mouthpiece and/or on the activation element on the internal circumference or on the external circumference, said anti-rotation protrusion in a sliding position that is preferably advanced counter to the throughflow direction being capable of being introduced into at least one anti-rotation clearance on the respective other component of the sanitary unit.

In order for the sliding movement of the handling element that is preferably configured as a sleeve-shaped activation element and is guided so as to be displaceable on the outlet mouthpiece to be transmitted to the component that is adjustable in the functional element, it is advantageous for the transmission element to have at least one transmission pin.

The easy handling of the activation element and the reliable transmission of the sliding movement that is exerted on the activation element to a respective actuating movement of the component that is provided in the functional element are yet additionally facilitated when the transmission element, and in particular the transmission pin thereof, is guided so as to be axially displaceable in a sliding opening that is disposed centrally in the functional element.

In order for the outlet cross section of the sanitary functional unit to not be impeded or restricted, it is advantageous for the outlet structure to have at least two, and preferably more than two, connection webs which connect the activation element to the transmission element, and in particular to the at least one transmission pin, and for the connection webs of said outlet structure to engage on the internal circumference of the activation element at preferably uniform spacings.

One preferred embodiment according to the invention herein provides that the connection webs of the outlet structure that connect the activation element to the transmission pin are disposed in a stellar or radial manner on the activation element, for example in the sleeve opening of a sleeve-shaped activation element.

Exemplary embodiments according to the invention that are producible in a particularly simple manner provide that the activation element is integrally connected to the at least one connection web, and/or the at least one connection web is integrally connected to the at least one transmission pin.

In order for the sanitary unit according to the invention to be able to be designed in an ideally space-saving manner and so as to have an ideally minor axial longitudinal extent, it is advantageous for the at least one connection web at least in a sliding terminal position that faces the water outlet to penetrate an assigned elongate hole in the outlet mouthpiece.

In order for a rotary force that is exerted on the activation element to be able to be transmitted by way of the outlet mouthpiece that is held on the water outlet by a screw connection, it is advantageous for the at least one connection web to be guided so as to be rotationally secured but displaceable in the elongate hole assigned to said connection web. If the connection web is guided so as to be rotationally secured in the elongate hole assigned thereto, a rotating movement exerted on the activation element serving as a handling element can be used for screw-fitting or unscrewing said screw connection.

One preferred embodiment according to the invention provides that the activation element is held on the outlet mouthpiece so as to be displaceable between a sliding terminal position that faces away from the water outlet, in which the activation element is held so as to be freely rotatable on the outlet mouthpiece, and a sliding terminal position that faces the water outlet. In the case of a corresponding design embodiment of the activation element and of the outlet mouthpiece, in which the outlet structure on the activation element is formed by connection webs, it can be advantageous for the at least one connection web to engage in the elongate hole assigned thereto.

To this end it is particularly advantageous for the at least one elongate hole that is assigned to a connection web to be configured so as to be open at the end peripheral side.

Preferred exemplary applications of the sanitary unit according to the invention provide that the component is configured as a closure member or a valve member which in one of the functional positions thereof closes at least one cleaning opening or valve opening.

One preferred embodiment according to the invention provides that the activation element is configured so as to be sleeve-shaped. However, it is also possible for the activation element that is configured as a handling element to be formed merely by at least two engagement faces for the thumb and the index finger, said engagement faces being held so as to be displaceable, or guided so as to be displaceable, on opposite sides of the sanitary unit.

BRIEF DESCRIPTION OF THE DRAWINGS

Refinements according to the invention are derived from the claims in conjunction with the drawing as well as the description. The invention will be described in yet more detail hereunder by a preferred exemplary embodiment.

In the Figures.

DETAILED DESCRIPTION

Figure 4:
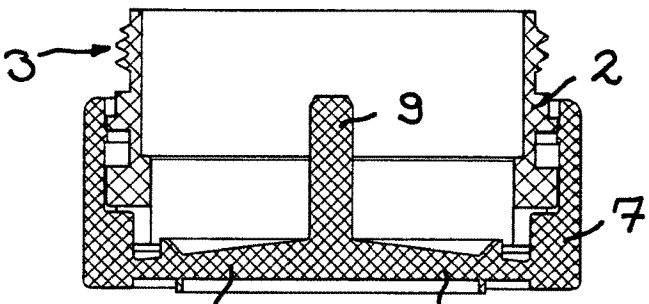
FIG. 4 shows the outlet mouthpiece and the activation element of the sanitary unit from FIGS. 1 to 3, in a longitudinal section, in the second functional position shown in FIG. 3.
Figure 2:
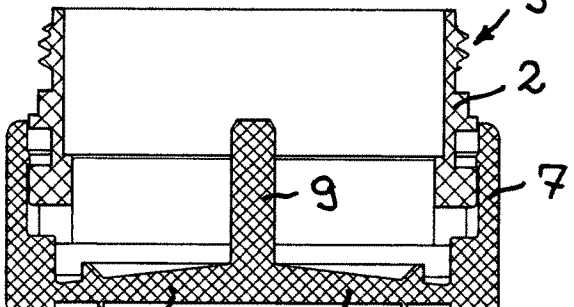
FIG. 2 shows the outlet mouthpiece and the activation element of the sanitary unit from FIG. 1 that is guided so as to be displaceable on the outlet mouthpiece in a longitudinal section, in the first functional position shown in FIG. 1.
Figure 5:
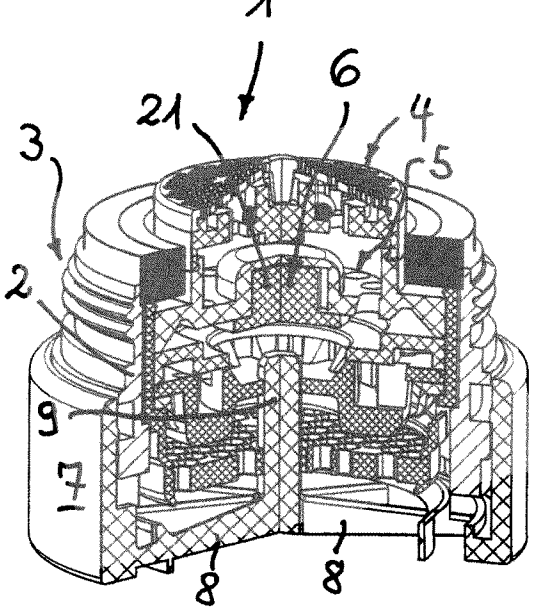
FIG. 5 shows the longitudinally cut sanitary unit from FIGS. 1 to 4 in the first functional position of the component thereof, immediately after the activation of the outlying activation element that serves as the handling element.
Figure 3:
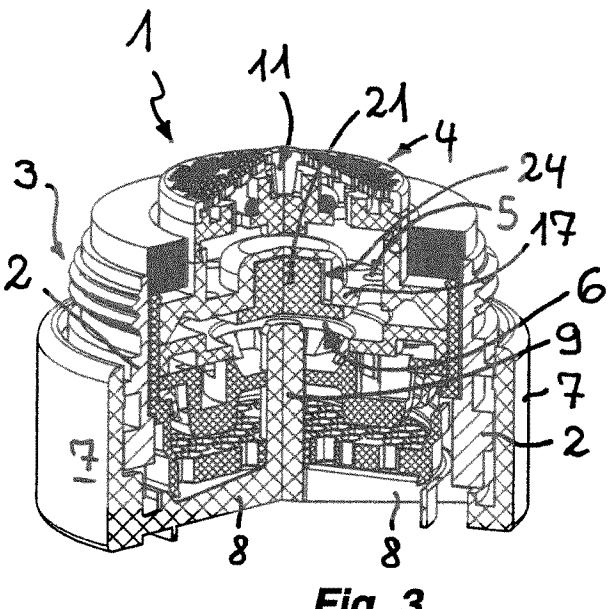
FIG. 3 shows the sanitary unit from FIGS. 1 and 2, likewise here in a longitudinal section, in a second functional position of the component thereof.
Figure 1:
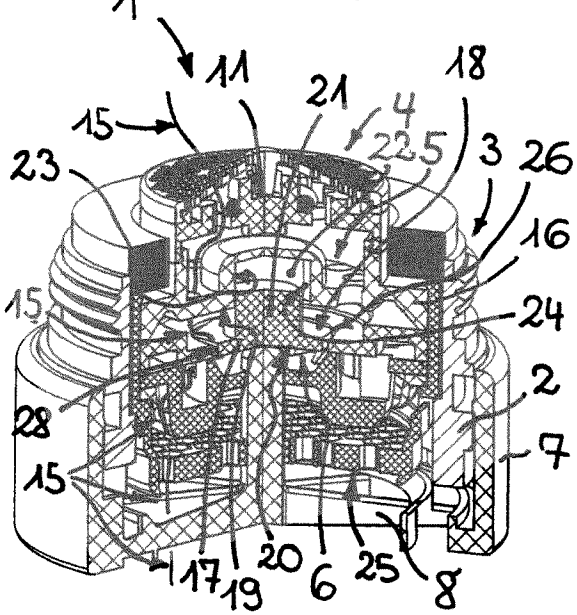
FIG. 1 shows a sanitary unit illustrated in a longitudinal section, said sanitary unit having a sleeve-shaped outlet mouthpiece which is capable of being assembled on a water outlet of a sanitary outlet fitting, and having a sleeve interior in which a sanitary functional unit having at least one functional element is inserted, said functional element having an adjustable component which by an externally accessible handling element is adjustable between at least two functional positions, wherein this handling element here is designed as a sleeve-shaped activation element which is guided so as to be displaceable on the external circumference of the outlet mouthpiece, and wherein the component here is shown in a first functional position.
Figure 7:
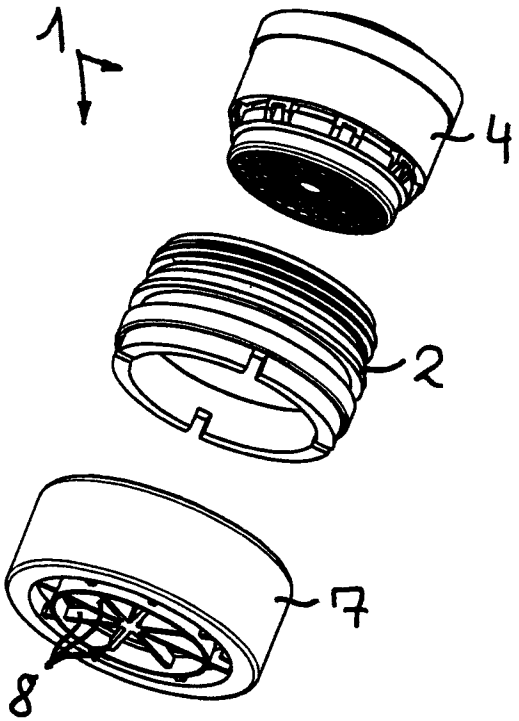
FIG. 7 shows the activation element, the outlet mouthpiece, as well as the sanitary functional unit of the sanitary unit from FIGS. 1 to 6, in an exploded perspective illustration.
Figure 6:
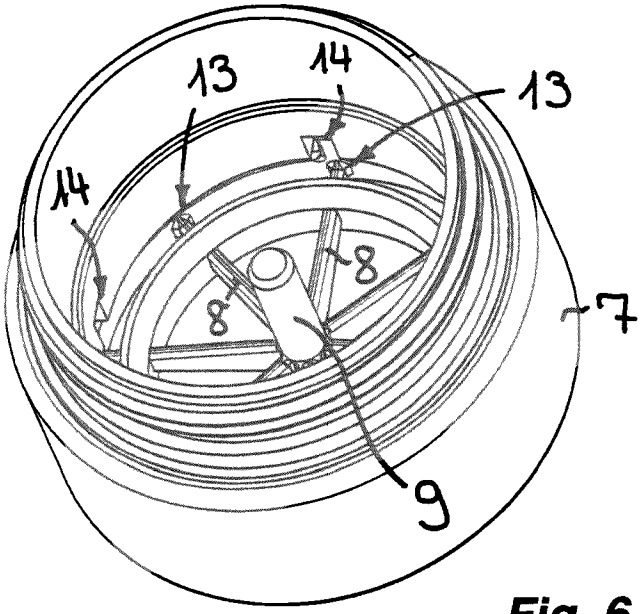
FIG. 6 shows the activation element that serves as the handling element, as well as the outlet mouthpiece of the sanitary unit from FIGS. 1 to 5, in a plan view of the inflow side.
Figure 11:
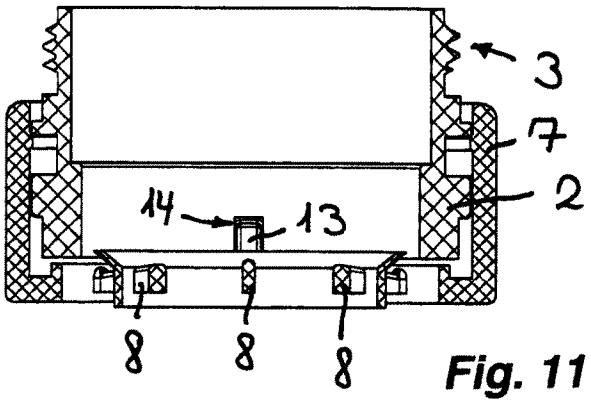
FIG. 11 shows the activation element as well as the outlet mouthpiece of the sanitary unit shown in FIGS. 8 to 10, in a section oriented in the longitudinal direction in the section plane II-II from FIG. 10.
Figure 10:
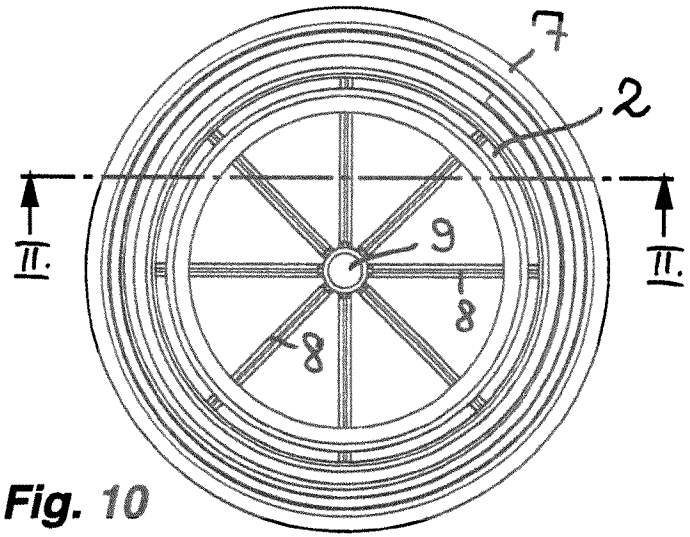
FIG. 10 shows the activation element as well as the outlet mouthpiece from FIGS. 8 and 9 in a plan view, wherein these component parts of the sanitary unit here are located in the second functional position.
Figure 9:
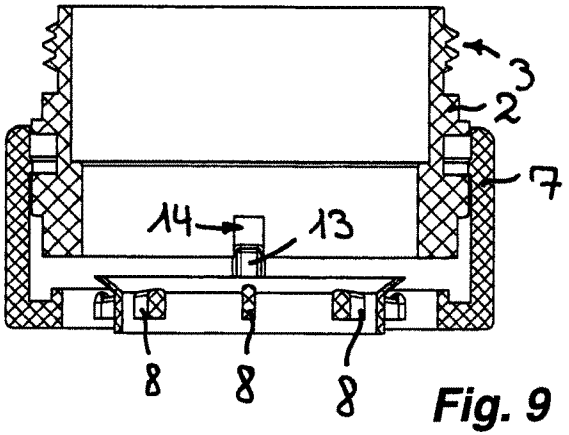
FIG. 9 shows the activation element as well as the outlet mouthpiece of the sanitary unit shown in FIG. 8, in a section oriented in the longitudinal direction in the section plane I-I from FIG. 8.
Figure 8:
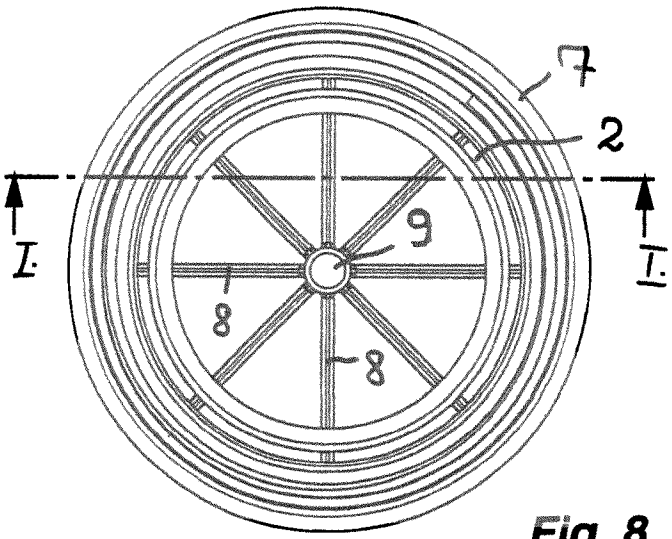
FIG. 8 shows the activation element that serves as the handling element, as well as the outlet mouthpiece of the sanitary unit from FIGS. 1 to 7, in an inflow-side plan view.
Figure 13:
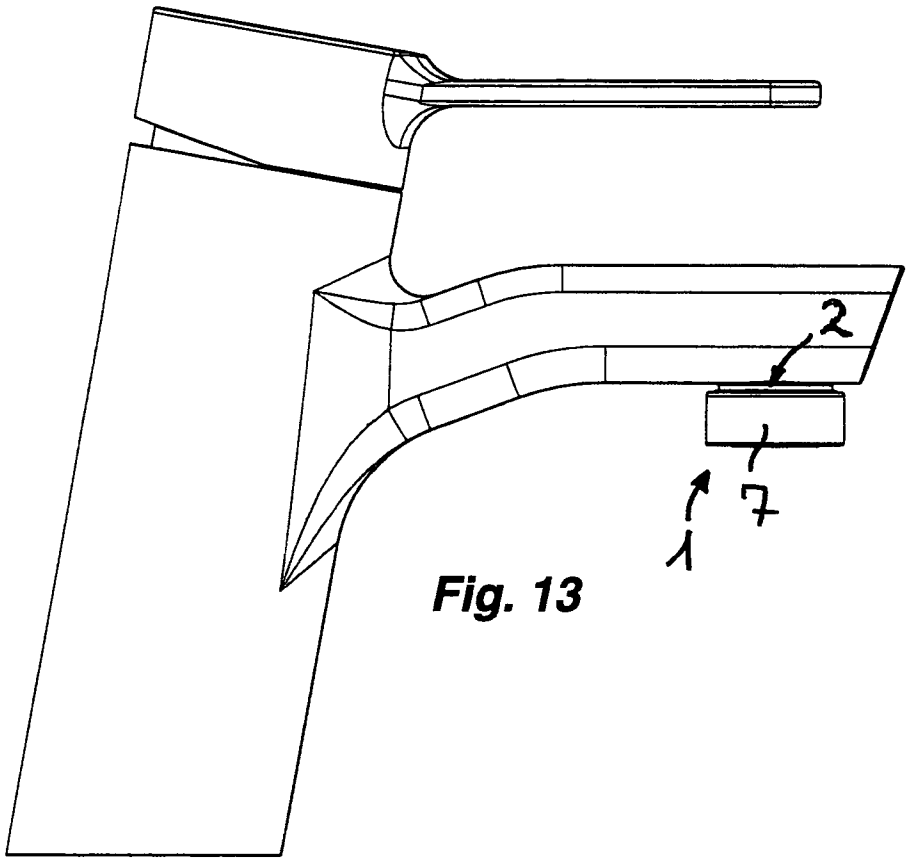
FIG. 13 shows the sanitary unit having the outlet mouthpiece thereof assembled on the sanitary outlet fitting according to FIG. 12, in a lateral view.
Figure 12:
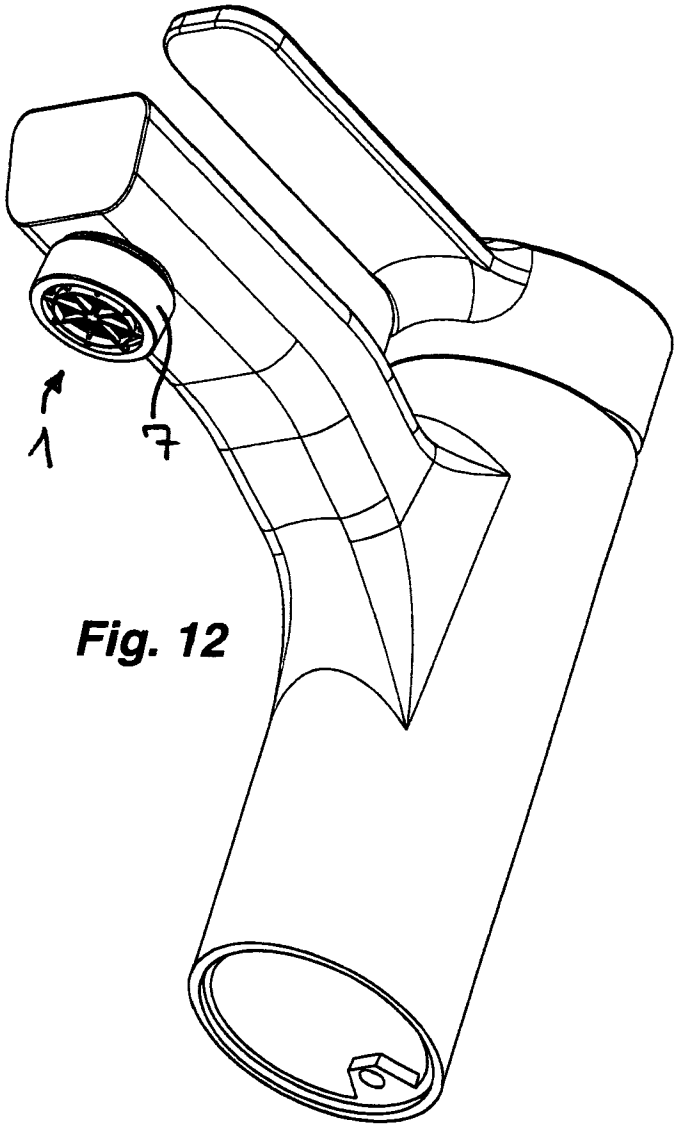
FIG. 12 shows the sanitary unit from FIGS. 1 to 11, having the outlet mouthpiece thereof assembled on a sanitary outlet fitting, in a perspective view.
Figure 18:
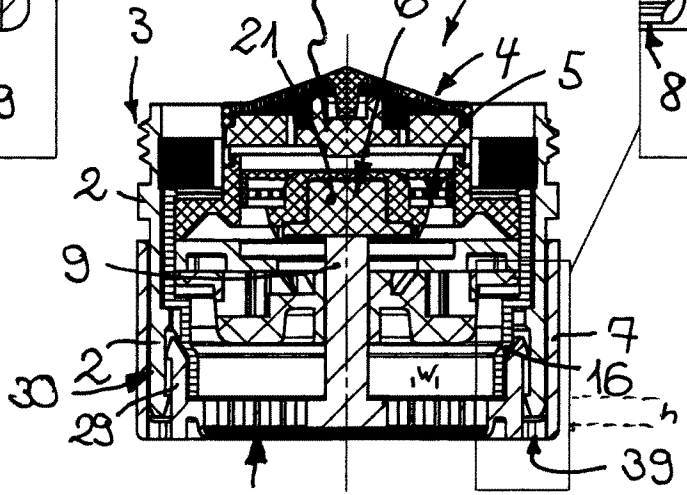
FIG. 18 shows an exemplary embodiment of a sanitary unit comparable to that of FIG. 16 in a longitudinal section, wherein the jet regulator that is located in the functional unit of the sanitary unit shown here is likewise configured as a jet aerator.
Figure 16:
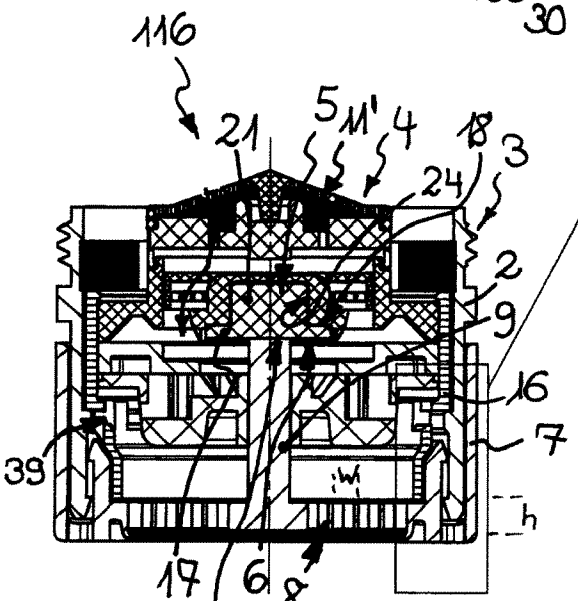
FIG. 16 shows a further exemplary embodiment of a sanitary unit illustrated in a longitudinal section, said sanitary unit with the aid of a sleeve-shaped outlet mouthpiece being capable of being assembled on the water outlet of a sanitary outlet fitting, wherein a functional unit having an aerated jet regulator which is intended to form the water flowing therethrough to a homogeneous, splash-free and here also a pearly-soft water jet is insertable into the sleeve interior of the outlet mouthpiece, and wherein the functional unit is selectively activatable by an outlying activation element between two functional positions.
Figure 21:
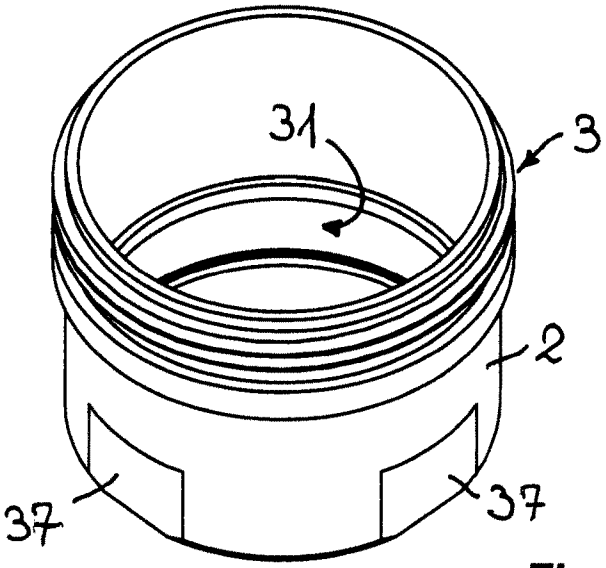
FIG. 21 shows the outlet mouthpiece that is assigned to the activation element from FIG. 20 in a perspective plan view of the inflow side.
Figure 20:
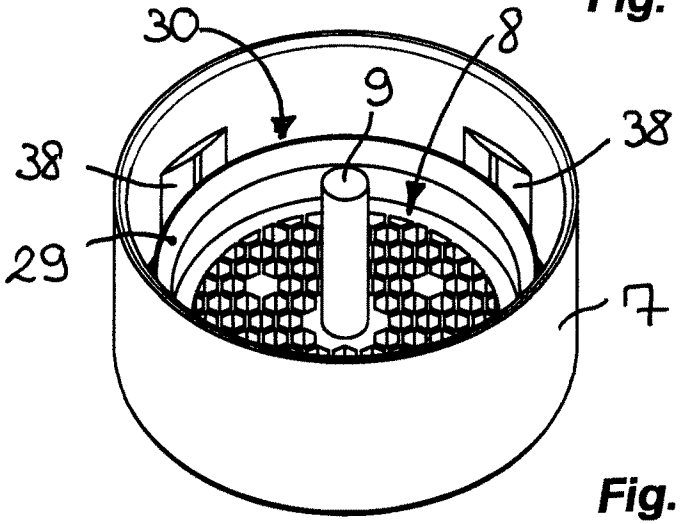
FIG. 20 shows the activation element of the sanitary units shown in FIGS. 16 and 18, in a perspective plan view of the inflow side.
Figure 23:
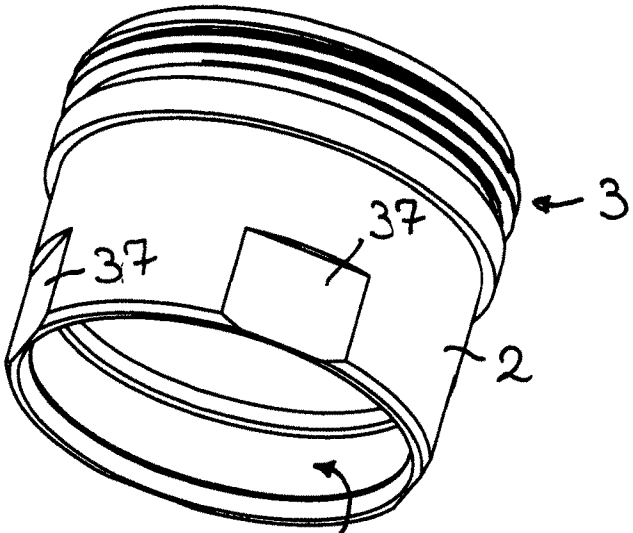
FIG. 23 shows the outlet mouthpiece from FIG. 21 in a perspective view from below.
Figure 22:
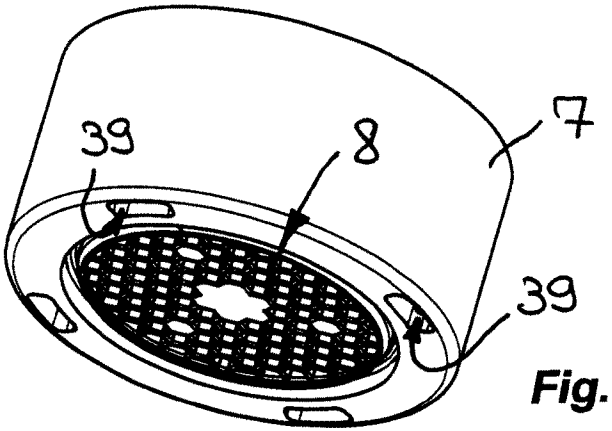
FIG. 22 shows the activation element from FIG. 20 in a perspective view from below of the outflow-side end side.
Figure 24:
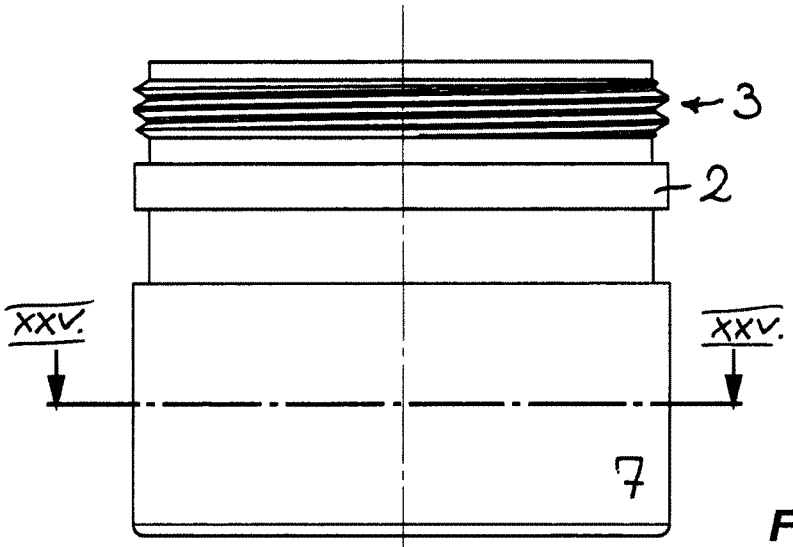
FIG. 24 shows the outlet mouthpiece from FIGS. 21 and 23 in a lateral view.
Figure 25:
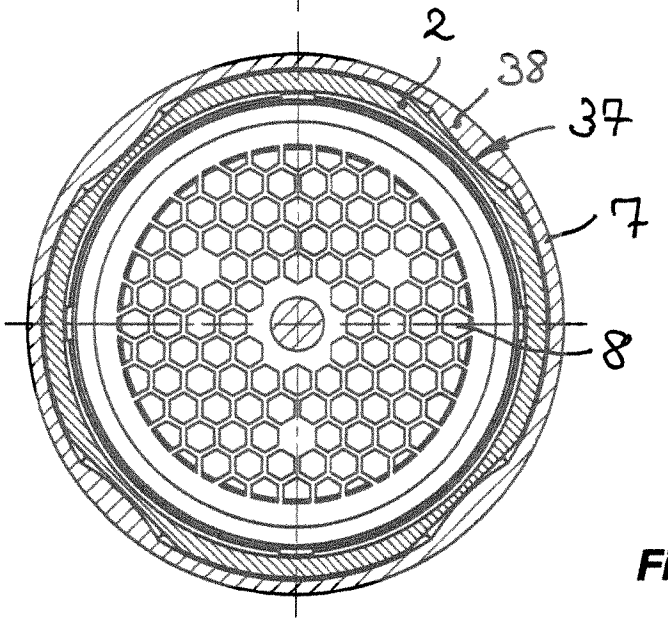
FIG. 25 shows the activation element and the outlet mouthpiece from FIGS. 20 to 24 in a sliding position when pushed into one another on the sliding path of the activation element on the outlet mouthpiece, wherein said component parts here are shown in a cross section through the section plane XXV-XXV according to FIG. 24.

A sanitary unit in various exemplary embodiments 1, 116, and 118 which have a sleeve-shaped outlet mouthpiece 2 is illustrated in FIGS. 1, 3, 5, as well as in FIGS. 16 and 18. The sanitary units 1, 116, 118 with the aid of a thread that is provided on the sleeve-shaped outlet mouthpiece 2 are capable of being releasably assembled on a counter thread on the water outlet of a sanitary outlet fitting. As becomes evident in an exemplary manner when viewing FIGS. 1, 3, 5, 16, and 18, on the one hand, and FIGS. 12 and 13, on the other hand, in comparison the outlet mouthpiece 2 to this end here has an external thread 3 which is screw-fittable into an internal thread on the water outlet of the sanitary outlet fitting.

The outlet mouthpiece 2 of the sanitary units 1, 116, and 118 has a sleeve interior in which is inserted a sanitary functional unit 4. The sanitary functional unit 4 which is preferably configured as an insert cartridge can have an attachment screen or filter screen on the inflow side, which is connected to a jet regulator as a further functional element 5 of the functional unit 4. In the exemplary embodiment 1 shown in FIGS. 1, 3 and 5 a flow rate regulator 11 is interposed between the attachment screen or filter screen and the jet regulator that is provided as the further functional element 5, said flow rate regulator 11 in the pressure-independent manner regulating and limiting the water volume that flows through the functional element 5 to an established maximum value per unit of time. This flow rate regulator 11 here largely protrudes into the screen interior that is delimited by the attachment screen or filter screen. By contrast, the exemplary embodiments 116, 118 illustrated in FIGS. 16 and 18 instead have a throttle 11' which substantially reduces the flow cross-section in the region of the throttle 11'.

In order for the available flow cross-section or the throughflow performance to be increased when required, a component 6 which is configured as a closure member or valve member is provided in the functional element 5, said component 6 by an externally accessible handling element being adjustable between at least two functional positions by way of a transmission element 9 which is guided so as to be axially displaceable in the functional element 5. The component 6 herein in a first functional position, shown for example in FIGS. 1 and 5, can close a valve opening, while the component 6 in at least one second functional position which is shown in an exemplary manner in FIG. 3 is spaced apart from the valve opening and releases the latter.

The handling element is designed as an activation element 7 and in the exemplary embodiment illustrated here is a sleeve-shaped activation element 7 which is held so as to be displaceable on an external circumference of a part-region of the outlet mouthpiece 2 that projects beyond the water outlet of the outlet fitting. The activation element 7 is connected to the transmission element 9 by way of at least one running transverse to the outlet structure 8 of the sanitary units 1, 116, and 118. The transmission element 9 here is configured as a transmission pin which is guided so as to be axially displaceable in a sliding guide of the functional element 5 that is disposed centrally in the functional element 5.

Figure 15:
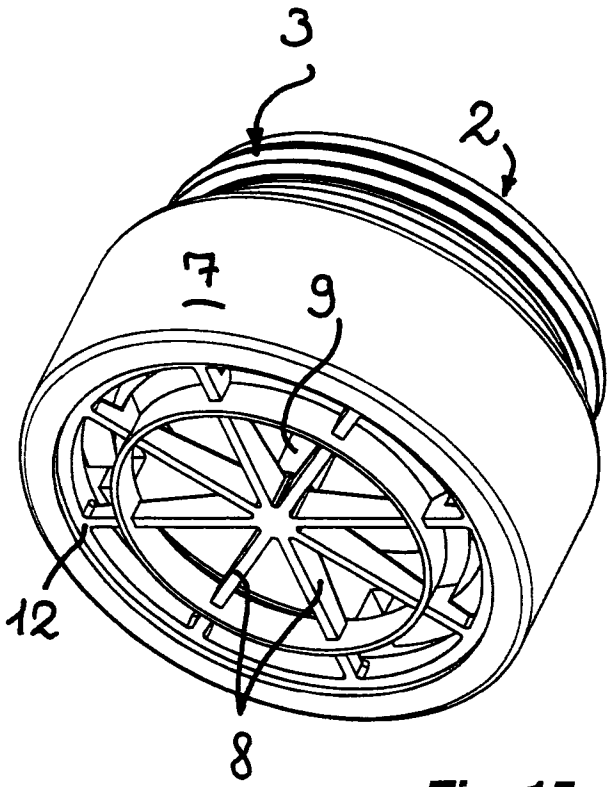
FIG. 15 shows the activation element and the outlet mouthpiece from FIG. 14 in a perspective plan view of the outflow side of said component parts of a sanitary unit.
Figure 14:
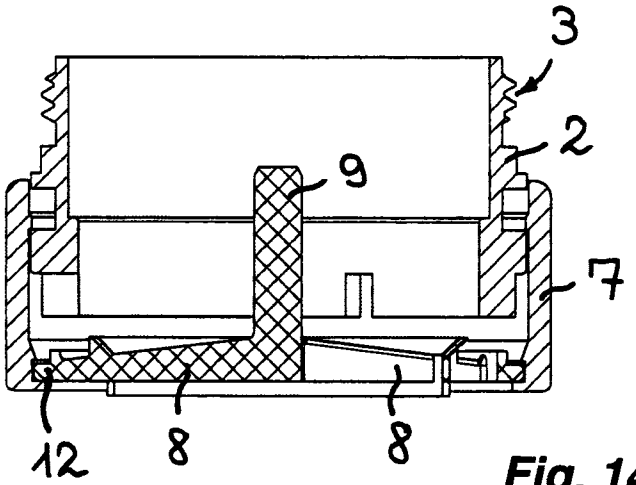
FIG. 14 shows the activation element serving as a handling element, and the outlet mouthpiece of a sanitary unit that is designed in a manner comparable to that of FIGS. 1 to 13, wherein the outlet structure that is provided on the outflow side is produced separately and is optionally also releasably inserted in the activation element that serves as a handling element.
Figure 19:
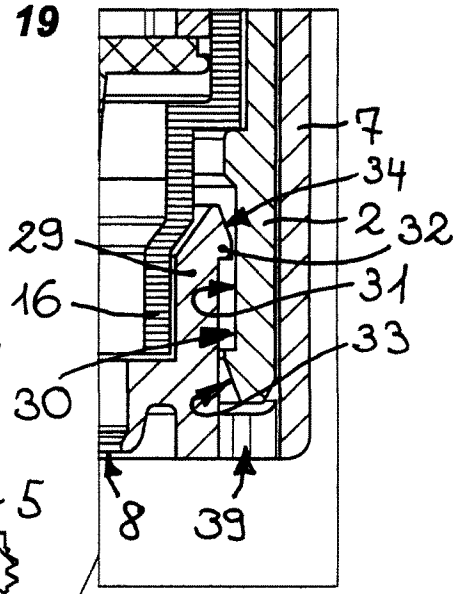
FIG. 19 shows the sanitary unit from FIG. 18 in a longitudinal section of the detail in the outflow-side region between the functional unit, the outlet mouthpiece, and the activation element.
Figure 17:
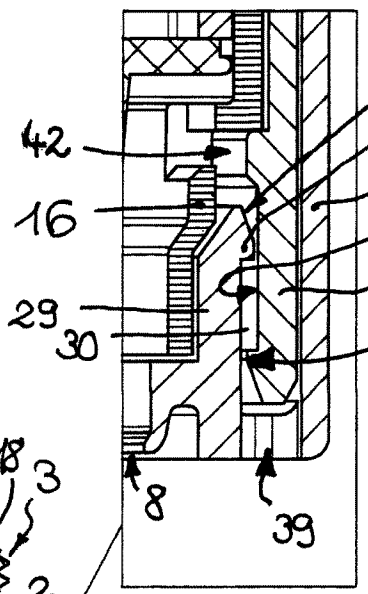
FIG. 17 shows the sanitary unit from FIG. 16 in a longitudinal section of the detail in the outflow-side region between the functional unit, the outlet mouthpiece, and the activation element.

It becomes evident from viewing FIGS. 1, 3, 5 to 8, and 10 in comparison that the sanitary unit 1 has an outlet structure 8 which interconnects the activation element 7 as well as the transmission element 9 that is configured as a transmission pin, said outlet structure 8 being formed by at least two, and preferably more than two, connection webs. The connection webs of the outlet structure 8 that is provided in the sanitary unit 1 herein are held on the internal circumference of the activation element 7 at approximately uniform spacings. The connection webs 8 of the outlet structure that connect the activation element 7 to the transmission element 9 that is configured as a transmission pin are disposed in a stellar or radial manner in the sleeve opening of the sleeve-shaped activation element 7. While the connection webs of the outlet structure 8 are integrally connected to the transmission pin of the transmission element 9, the activation element 7 having the outlet structure 8 can also be configured in multiple parts. While the sleeve-shaped activation element 7, the connection webs of the outlet structure 8 that are disposed in a stellar or radial manner, and the transmission element 9 that is configured as a transmission pin are integrally interconnected in the exemplary embodiment 1 shown in FIGS. 1 to 11, the connection webs of the exemplary embodiment shown in FIGS. 14 and 15 that likewise form the outlet structure 8 by way of the end region of said connection webs that faces away from the transmission pin engage on an outlying external ring 12 which can be inserted into the activation element 7 and be latch-fitted therein.

In the case of the sanitary units 116 and 118 shown in FIGS. 16 and 18, the outlet structure 8 is configured as a honeycomb cell structure which is formed by webs that intersect at intersection points, said webs therebetween delimiting throughflow openings. This honeycomb-cell-shaped outlet structure 8 of the sanitary units 116, 118 offers a comparatively minor degree of resistance to the inflowing water. The honeycomb-cell-shaped outlet structure 8 herein is also integrally molded here to the activation element 7 that serves as the handling element and forms the outflow-side end side of the activation element 7. The transmission element 9 that is configured as a transmission pin projects counter to the throughflow direction on said honeycomb-cell-shaped outlet structure 8, wherein the transmission element 9 is integrally molded to the outlet structure 8. The webs that mutually intersect at intersection points and form the honeycomb-cell-shaped outlet structure 8 delimit honeycomb-cell-shaped throughflow openings which in the throughflow direction can have a height h which is larger than the maximum available cross section W of the throughflow openings when the outlet structure 8 is intended to simultaneously also serve as a flow rectifier for the exiting water.

The activation elements 7 of the sanitary units 1, 116, and 118 are configured so as to be sleeve-shaped and by way of the outlying sleeve circumference thereof bear so as to be displaceable on the external circumference of the outlet mouthpiece 2 that is associated with said units 1, 116, and 118. The units 116 and 118 shown in FIGS. 16 and 18 have a guide internal wall 29 which projects counter to the throughflow direction beyond the outlet structure 8 of the activation element 7. The outflow-side part-region of the circumferential wall of the outlet mouthpiece 2 herein is guided in the annular space 30 between the outlying sleeve circumference of the activation element 7 and the guide internal wall 29. It is illustrated in FIGS. 16 to 19 that the outlet mouthpiece 2 of the units 116, 118 on the internal circumference of the circumferential wall thereof has at least one guide groove 31 which extends in the throughflow direction and in which at least one guide groove 31, an assigned guide protrusion 32 which is disposed on the outlying sleeve circumference of the activation element 7 engages. Said at least one guide protrusion 32 interacts with the at least one guide groove 31 in such a manner that said preferably encircling guide groove 31 and the likewise preferably encircling guide protrusion 32 delimit the sliding path of the activation element 7 on the outlet mouthpiece 2.

In order for the outlet mouthpiece 2 and the activation element 7 of the sanitary units 116, 118 to now be able to be interconnected in a displaceable manner, the outlet mouthpiece 2 on the internal circumference on the outflow-side end peripheral region and the guide internal wall 29 of the activation element 7 on the external circumference on the free end peripheral region of the latter have in each case one ramp 33, 34, said ramps 33, 34 interacting for snap-fitting, or latch-fitting, respectively, the guide protrusion 32 in the guide groove 31.

In order for a rotating movement on the activation element 7 to also be able to be transmitted to the outlet mouthpiece 2, the activation element 7 and the outlet mouthpiece 2 of the sanitary units 1, 116, and 118 are capable of being interconnected in a rotationally fixed manner at least in a part-region of the sliding path of the activation element 7 on the outlet mouthpiece 2. In as far as the activation element 7 and the outlet mouthpiece 2 are located in the rotationally fixed sliding position that however is displaceable in the longitudinal direction, a rotating force exerted on the activation element 7 can also be transmitted to the outlet mouthpiece 2 such that the outlet mouthpiece 2 that is held on the water outlet by a screw connection can be selectively screw-fitted or unscrewed thereon.

In order for a rotating movement on the activation element 7 in the case of the sanitary unit 1 to also be able to be transmitted to the outlet mouthpiece 2, the connection webs that form the outlet structure 8, at least in a sliding terminal position of the activation element 7 that faces the water outlet, can penetrate an assigned elongate hole 10 in the outlet mouthpiece 2. In the case of the exemplary embodiment of a sanitary unit 1 that is shown in FIGS. 1 to 11, at least one holding pin 13 that is molded projects in the activation element 7, said holding pin 13 at least in a sliding terminal position at the inflow side, and preferably at all times, engaging with an assigned holding clearance 14 on the outflow-side end periphery of the outlet mouthpiece 2. The at least one holding pin 13 and the at least one assigned holding clearance 14 cause the outlet mouthpiece 2 and the activation element 7 that serves as the handling element to be guided so as to be rotationally secured but displaceable in one another.

As becomes evident when viewing FIGS. 27 to 33 in comparison, an anti-rotation protrusion 35 which projects into the annular space 30 is provided on the activation element 7 in the case of the sanitary units 116, 118. This anti-rotation protrusion 35 in a sliding position that is preferably advanced counter to the throughflow direction is capable of being introduced into at least one anti-rotation clearance 36 on the outlet mouthpiece 2, said anti-rotation clearance 36 being configured so as to be open toward the outflow-side end periphery of the outlet mouthpiece 2. Should the anti-rotation protrusion 35 that projects into the annular space 30 engage in the anti-rotation clearance 36 on the outlet mouthpiece 2, the activation element 7 and the outlet mouthpiece 2 are displaceable relative to one another but nevertheless mutually held so as to be rotationally fixed.

In order for an anti-rotation to be established between the activation element 7 and the outlet mouthpiece 2, the outlet mouthpiece in the case of the exemplary embodiment shown in FIGS. 20 to 23, at least in a part-region of the longitudinal extent of said outlet mouthpiece, has a shaping that at least in a circumferential portion deviates from the circular cross section, in particular a shaping that is configured as a preferably planar sinking 37. The sleeve-shaped activation element 7 in the exemplary embodiment shown in FIGS. 20 to 23 on the sleeve internal circumference of said activation element 7, at least in one portion of the longitudinal extent thereof, has at least one protrusion 38 which in a sliding position that is preferably advanced counter to the throughflow direction of the activation element 7 can be moved to be congruent with the at least one part-region 37 of the outlet mouthpiece that deviates from the circular cross section in such a manner that the activation element 7 and the outlet mouthpiece 2 are mutually held in a rotationally fixed manner.

Figure 26:
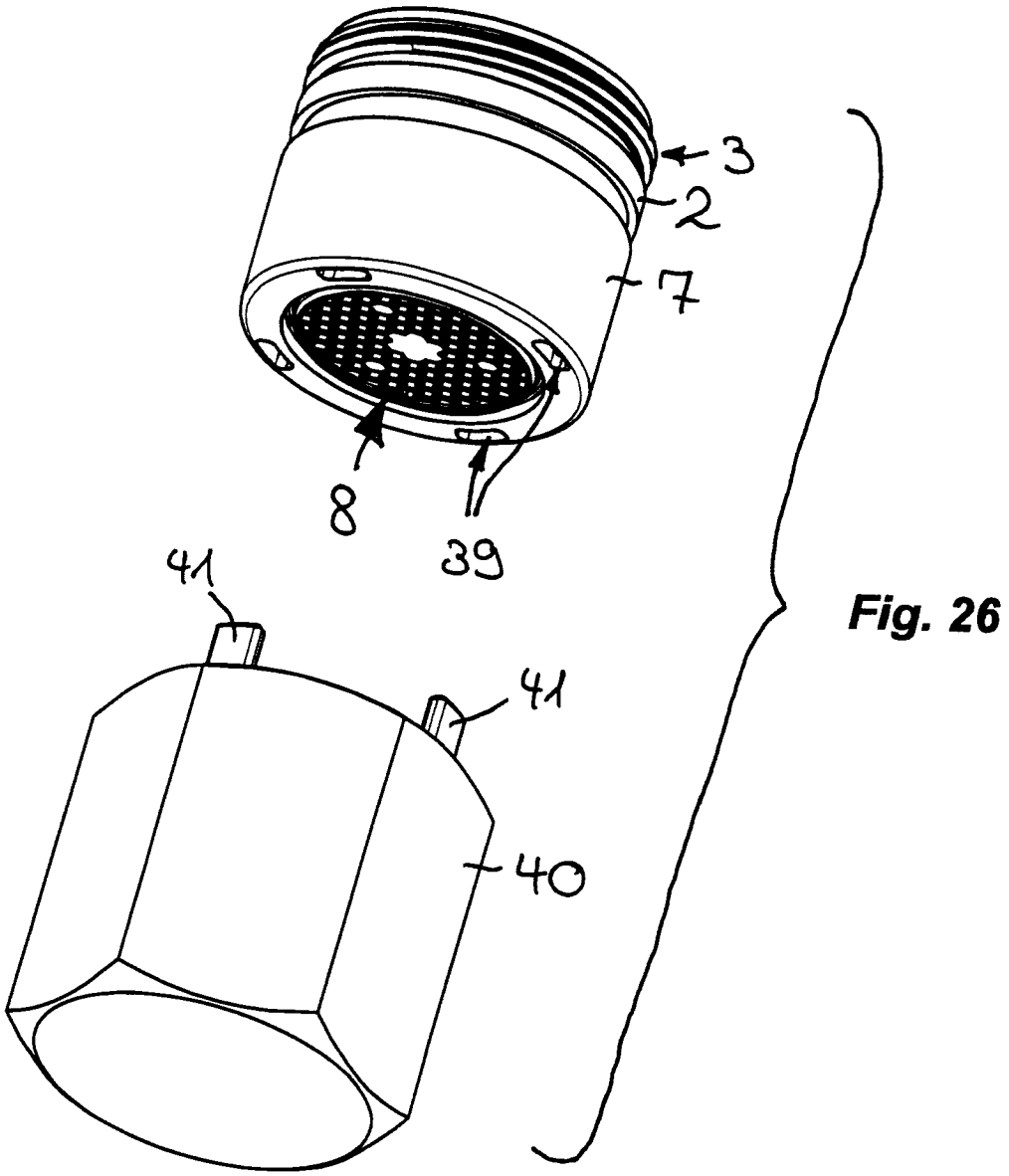
FIG. 26 shows the outlet mouthpiece and the activation element from FIGS. 20 to 25 pushed thereon, having a rotating tool which here is located immediately prior to being engaged on the outflow side of the activation element.
Figure 27:
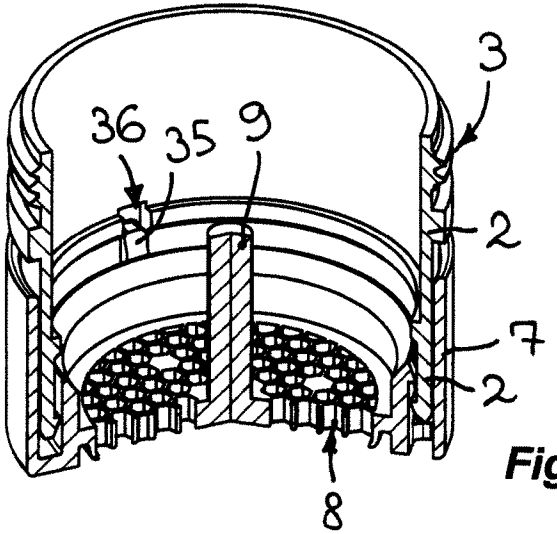
FIG. 27 shows an activation element and an associated outlet mouthpiece in a further embodiment in which said component parts by an anti-rotation protrusion in the interior of the activation element and of an associated anti-rotation clearance on the outlet mouthpiece can engage in one another in a rotationally fixed manner in a sliding position.
Figure 28:
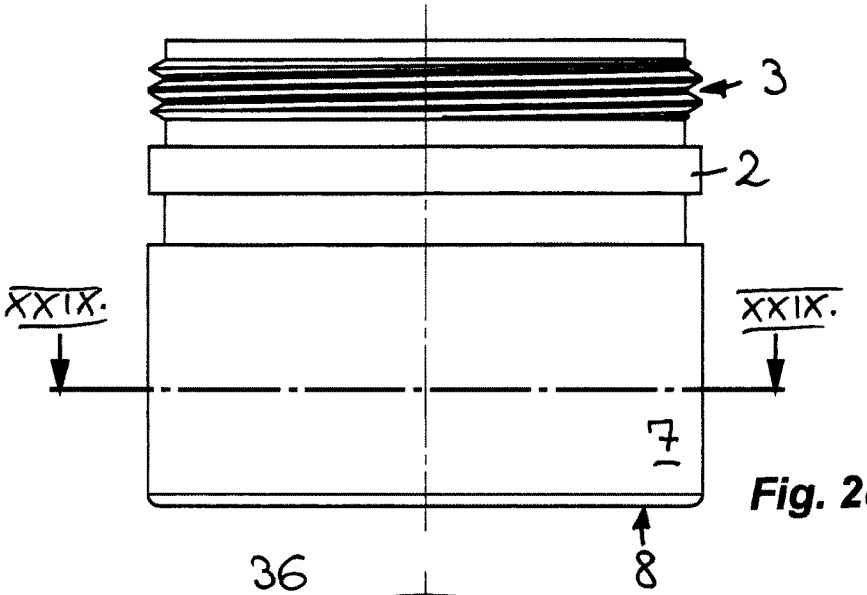
FIG. 28 shows the outlet mouthpiece and the activation element from FIG. 27 that is held so as to be displaceable along the former, in a lateral view.
Figure 29:
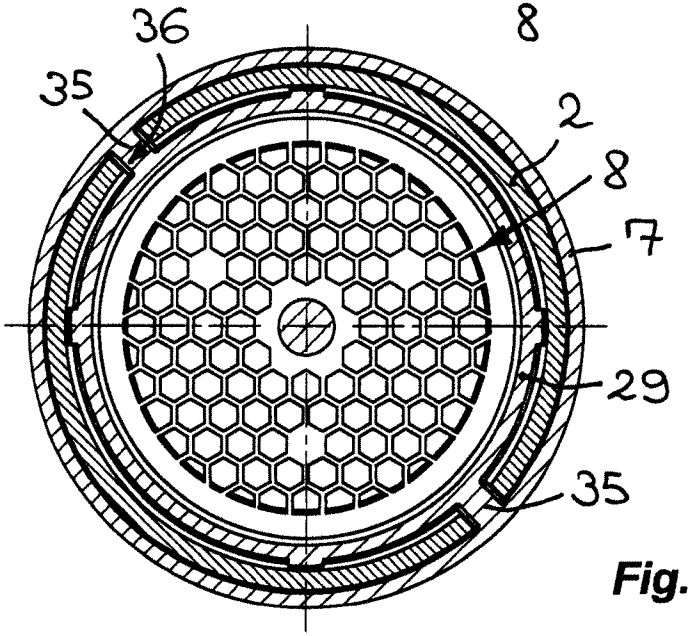
FIG. 29 shows the activation element and the outlet mouthpiece from FIGS. 28 and 29 in a cross section through the section plane XXIX-XXIX in FIG. 28.
Figure 31:
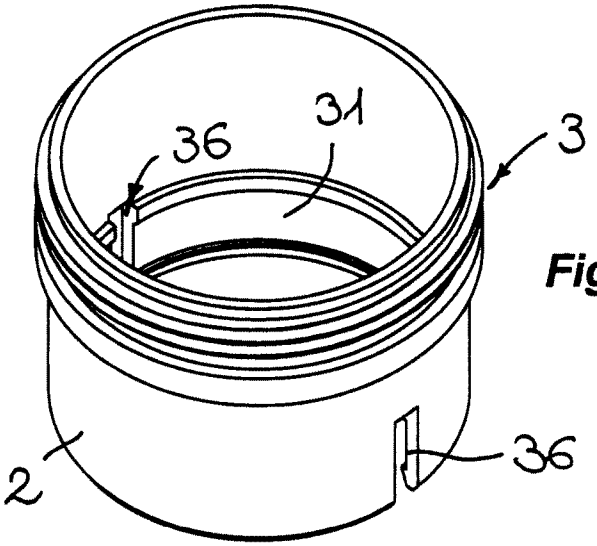
FIG. 31 shows the outlet mouthpiece that is assigned to the activation element according to FIG. 30, in a perspective plan view of the inflow side.
Figure 30:
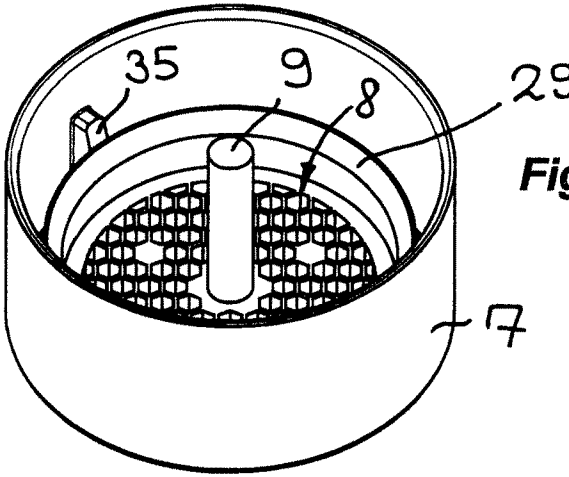
FIG. 30 shows the activation element from FIGS. 27 to 29 in a plan view of the inflow side of the former.
Figure 32:
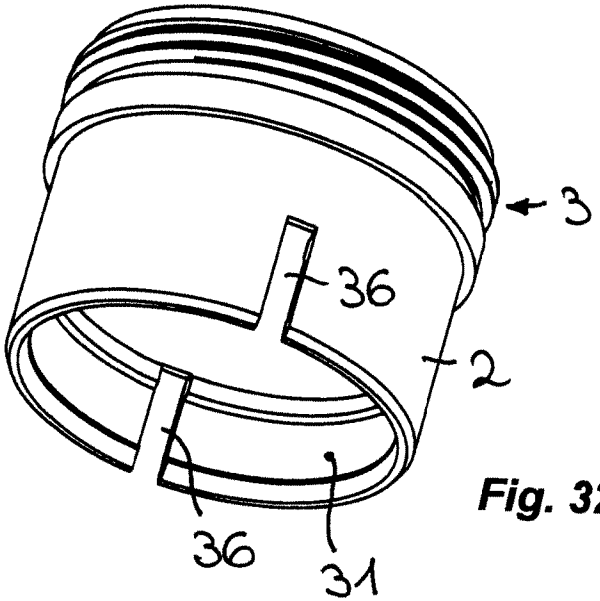
FIG. 32 shows the outlet mouthpiece according to FIG. 31 in a perspective view from below of the outflow side of said outlet mouthpiece.
Figure 33:
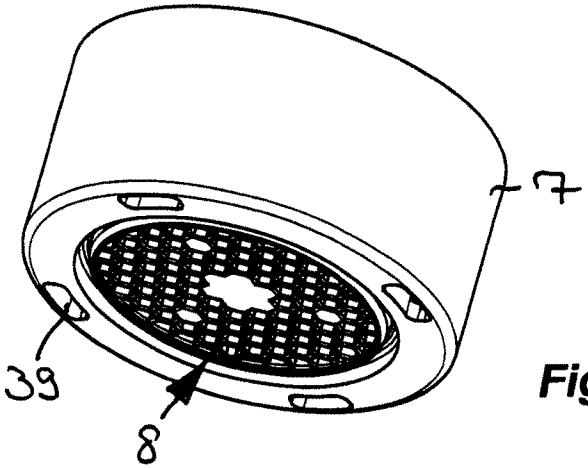
FIG. 33 shows the activation element from FIGS. 27 to 30 in a plan view of the outflow side of the former.

In the rotationally fixed sliding position of the activation element 7 and the outlet mouthpiece 2, a rotating force can also be exerted manually on the activation element 7 of the units 1, 116, 118. By contrast, the exemplary embodiment shown in FIG. 26 on the outlet end side of the activation element 7 has a plurality of holes 39 that in the circumferential direction are mutually, preferably uniformly, spaced apart. The holes 39 that are mutually spaced apart on the outlet end side of the activation element 7 are in each case configured as an aeration opening that opens into the annular space 30 between the outlying sleeve circumference of the activation element 7 and the guide internal wall 29 of the latter. Said holes 39 simultaneously also serve as a tool engagement location for a rotating tool 40 that is attachable to the end side on the activation element 7. Said rotating tool 40 has projecting engagement pins 41 which can in each case be brought to engage in one of the holes 39 on the outflow-side end side of the activation element 7.

The component 6 in the sanitary units 1, 116, 118 here is configured as a valve element which in the first and the second functional position closes at least one valve opening. The available throughflow cross section or the throughflow performance of the functional element 5 can be varied when required by activating the component 6 that is configured as a valve element. National legislation indeed often provides that a flow rate in a standard operation is intended to be restricted to a prescribed value. However, it can also be the requirement of the user that flow rate restrictions of this type are able to be briefly cancelled so as to, for example, wash and purge items that are comparatively heavily contaminated. The functional unit that here as a whole is identified by 4 to this end configures a flow path 15 in the interior for water flowing therethrough. The flow path 15 is configured in a manner known per se in a housing 16 that is optionally also in multiple parts. The component which is configured as the valve element 6 and which is switchable between an open position (cf. FIGS. 3 and 5, for example) and a closed position (cf. FIG. 1, for example) is disposed in the flow path 15.

The closed position herein is disposed below the open position when the functional unit that is provided in the sanitary unit 1 when in use is inserted in the orientation according to FIGS. 1, 3 and 5. To this end, the closed position can be disposed exactly below the open position or under the open position, however laterally offset to a position exactly below.

In use, the functional unit 4 is held in a manner known per se on the outlet fitting by the outlet mouthpiece 2.

A bearing face 18 is configured on the component 6 that serves as a valve element. A communicating counter face 19 which interacts with the bearing face 18 in such a manner that the counter face 19 in the open position of the component 6 bears in a planar manner on the bearing face 18 is configured on the housing 16 or on a construction element of the functional unit 4 that is upstream in the sliding direction. By contrast, the bearing face 18 in the closed position is disposed so as to be spaced apart from the counter face 19.

The counter face 19 in the closed position is accessible from the flow path 15 and is therefore wetted in the presence of water in the flow path 15.

Moreover, an impingement face 20 is configured on the component 6 that serves as the valve element. The impingement face 20 is oriented downward, while the bearing face 18 is oriented upward. In other words, the impingement face 20 is aligned in an orientation that faces away from the bearing face 6.

The impingement face 20 in the open position of the component 6 that serves as the valve element is thus impinged with pressure and pushes the valve element against the counter face 19. A displacement member 21 which fits into a receptacle space 22 is configured on the component 6 that serves as the valve element.

The displacement member 21 herein in an only exemplary manner is illustrated having a cylindrical shape. The displacement member 21 is guided in a displaceable manner in the receptacle space 22 by way of the internal contour of the latter. The displacement member 21 in the open position completely fills the receptacle space 22. By contrast, the displacement member 21 in the closed position is partially disposed outside the receptacle space 22 and protrudes into the latter only to the extent as is required for the displaceable guiding mentioned.

A plurality of relief ducts 24 by way of which water that is displaced from the receptacle space 22 can flow back into the flow path 15 are configured between the displacement member 21 and an internal wall 23 of the receptacle space 22.

The rod-shaped transmission element 9 which is operable from the outside by way of the activation element 7 is configured below the component 6 that serves as the valve element. In the exemplary embodiment of the sanitary unit 1, 116, 118 shown in FIGS. 1 to 11, the transmission element 9 is guided so as to be displaceable in a honeycomb-shaped outlet end side 25 of the functional unit that is provided with honeycomb-cell-shaped throughflow holes, said transmission element 9 impinging from below the component 6 that serves as the valve element on the impingement face 20.

The transmission element 9 is configured so as to be separate from the valve element such that a part of the impingement face 20 is capable of being covered and released by the transmission element 9. Said part of the impingement face 20 herein is covered in FIG. 3 and released in FIG. 5, for example.

The impingement face 20 in the flow path 15 is disposed upstream of the valve seat 26. The valve seat 26 forms a flow obstacle in the flow path 15 such that a pressure which holds the component 6 that serves as the valve element in the open position is built up ahead of the valve seat 26.

The bearing face 18 and the impingement face 20 are configured on an encircling rim 17 of the component 6 that serves as the valve element. The rim 17 in the closed position partially closes the valve seat 26 so as to achieve an additional constriction. To this end, flattened features 28 which in each case form passage gaps on the valve seat 26 are configured on the rim 17 which per se describes a round basic shape.

The flow rate regulator 11, known per se, or another flow rate restrictor, for example the throttle 11' shown in FIGS. 16 and 18, is disposed in the flow path 15 upstream of the component 6 that serves as the valve element, by way of which flow rate regulator 11 defined conditions are capable of being set in the environment of the valve element 17. The maximum throughflow performance of the functional unit 4 can be restricted with the aid of the flow rate regulator 11 or the throttle 11', or can be set to an established pressure-independent maximum value.

The bearing face 18 in the closed position is configured on the inflow side on the component 6 that serves as the valve element such that said valve element by way of the flow pressure is guided to the closed position and is held in the closed position as soon as the bearing face 18 is released from the counter face 19.

The displacement member 21 and the entire component 6 overall are made from brass. By contrast, the transmission element 9 and the activation element 7 that here is configured so as to be annular, as well as the housing 16 having the outlet structure 25, are made from plastics material.

FIG. 1 shows the resting state of the functional unit 4 that is located in the sanitary unit 1. The component 6 that serves as the valve element herein is disposed in the closed position.

In operation, the throughflow along the flow path 15 is thus defined by the component 6 that serves as the valve element and in particular by the flattened features 28 in the valve seat 26.

The component 6 that serves as the valve element is transferred to the open position according to FIG. 3 by manual pressure which can be applied to the activation ring 7 and be transmitted from the bottom to the top by way of the transmission element 9. Water from the receptacle space 22 herein is displaced by the displacement member 21 by way of the relief ducts 24.

The component 6 that serves as the valve element by way of the bearing face 18 thereof is pressed against the counter face 19 on the housing 16. In this open position, the impingement face 20 is impinged by the pressure that is built up or prevails in the flow path 15 such that the component 6 that serves as the valve element is held in the open position.

The component 6 that serves as the valve element therefore also remains in the open position when the transmission element 9 is left to its own devices and is released from the component 6 that is configured as the valve element and drops downward. This holding action in the open position is performed as long as water flows in the flow path 15 and the pressure required there is built up.

In the case of a drop in pressure in the flow path 15, the component 6 that serves as the valve element, conjointly with the displacement member 21, by way of the deadweight thereof drops back to the closed position according to FIG. 1.

The valve seat 26 in the open position has a maximum available internal cross section such that the flow rate is increased in relation to the closed position.

It can still be seen from FIGS. 1, 3 and 5 that the pressure which holds the component 6 that serves as the valve element in the open position is generated by the valve seat 26 and subsequent flow obstacles.

In the case of the sanitary units 1, 116, 118 illustrated here, a bearing face 18 is thus configured on a valve element (component 6) that in a flow path 15 is adjustable between an open position and a closed position, said bearing face 18 in the open position covering a communicating stationary counter face 19 and releasing the latter in the closed position such that the valve element 17 is held in a self-acting manner in the open position by the pressure in the flow path and in the case of a drop in pressure returns to the closed position. It is achievable due to this that the functional unit 4 after use returns in a self-acting manner to the restricting operation in which the component 6 that serves as the valve element in the closed position more heavily restricts the flow path 15 then in the open position. On the other hand, it is also achieved due to this that the component 6 that serves as the valve element can be specified so as to be capable of being held in a self-acting manner in the open position as long as sufficient water flows in the flow path and a sufficient pressure is thus built up. This facilitates the use since the user by way of the activation ring 7 and the transmission element 9 can, for example, manually transfer the component 6 that serves as the valve element to the open position, but does not have to hold the component 6 that serves as the valve element in this open position. This improves the use characteristics of the sanitary unit 1, wherein legal requirements according to which the standard setting in the normal operation is intended to be the flow-restricting setting, can simultaneously be met.

The sanitary units 116, 118 shown in FIGS. 16 and 18 also have a sanitary functional unit 4 which has a functional element 5 that is configured as an aerated jet regulator or a jet aerator. In order for ambient air to be able to be suctioned through the holes 39 that are provided on the outlet end side of the activation element 7 into the mixing zone that is located in the housing interior of the insert housing of the functional unit 4 by way of the annular space 30, the ambient air being mixed with the water flowing therethrough in the mixing zone, a suction opening 42 is provided on the housing circumference of the insert housing of the functional unit 4 of the sanitary unit 116. However, in the case of the sanitary unit 116 according to FIG. 16 there is the possibility for water from the outflow side to be able to make its way between the housing exterior wall 16 and the guide internal wall 29. Due to the capillary effect it can arise that the sleeve-shaped activation element 7 remains in the sliding terminal position thereof and no longer drops back. However, the function of the sanitary unit 4 is thereby impeded, and the formation of limescale and a bacterial infestation of the stagnant water are possible. In order to now prevent the sleeve-shaped activation element 7 from attaching or caking, such an aeration opening 42 is not provided in the housing external wall 16 of the sanitary unit 18. Since the functional unit 4 of the sanitary unit 118 shown in FIG. 18 also has a jet aerator, the ambient air there is suctioned from the outflow-side housing end face into the housing interior of the insert housing of the functional unit 4 and therein entrains the water that potentially ingresses between the housing external wall 16 and the guide internal wall 29. The at least one aeration opening in the case of the sanitary unit 118 herein is provided between the outflow-side end periphery of the housing wall and the inflow-side end side of the flow rectifier that forms the outlet end side of the functional unit 4, so as to be approximately in the region of the reference sign "8". The ambient air in the case of the sanitary unit 118 is thus suctioned through the annular space 30 and along the internal circumference of the guide internal wall 29 into the housing interior of the insert housing of the functional unit 4, because the functional unit 4 on the insert housing thereof on the circumference does not have any comparable suction openings.

LIST OF REFERENCE SIGNS

1 Sanitary unit (according to FIGS. 1 to 13)
2 Outlet mouthpiece
3 External thread
4 Functional unit
5 Functional element
6 Component
7 Activation element

8 Connection web
9 Transmission element
11 Flow rate regulator
12 External ring
13 Holding pin
14 Holding clearance
15 Flow path
16 Housing
17 Rim
18 Bearing face
19 Counter face
20 Impingement face
21 Displacement member
22 Receptacle space
23 Internal wall
24 Relief ducts
25 Outlet structure
26 Valve seat
28 Flattened features
29 Guide internal wall
30 Annular space
31 Guide groove
32 Guide protrusion
33 Ramp
34 Ramp
35 Anti-rotation protrusion
36 Anti-rotation protrusion
37 Sinking
38 Protrusion
39 Holes
40 Rotating tool
41 Engagement pin
42 Aeration opening
116 Sanitary unit (according to FIG. 16)
118 Sanitary unit (according to FIG. 18)

The invention claimed is:

1. A sanitary unit (1, 116, 118), comprising:

a sleeve-shaped outlet mouthpiece (2) that is adapted to be assembled on a water outlet of a sanitary outlet fitting, and has a sleeve interior;

a sanitary functional unit (4) having a functional element (5) inserted in the sleeve interior, said functional element (5) having a component (6) that is adjustable between at least two functional positions;

an externally accessible handling element having a transmission element (9) which is guided so as to be axially displaceable in the functional element (5) for moving the component (6) between the at least two functional positions;

the handling element comprises an activation element (7) which is held so as to be displaceable on an external circumference of a part-region of the outlet mouthpiece (2) that is adapted to project beyond the water outlet of the outlet fitting;

a water-jet-permeable or water-jet-guiding outlet structure (8) connects the activation element (7) to the transmission element (9) is held on the activation element (7);

the activation element (7) is sleeve-shaped and includes an outlying sleeve circumference that is displaceably supported on an external circumference of the outlet mouthpiece (2);

a guide internal wall (29) that projects counter to a throughflow direction beyond the outlet structure (8) of the activation element (7), and an outflow-side part-region of a circumferential wall of the outlet mouthpiece (2) is guided in an annular space (30) located between the outlying sleeve circumference of the activation element (7) and the guide internal wall (29); and the outlet mouthpiece (2) on an internal circumference of the circumferential wall thereof has at least one guide groove (31) which extends in a throughflow direction and an assigned guide protrusion (32) that is disposed on the outlying sleeve circumference of the activation element (7) engages the at least one guide groove (31), said guide protrusion (32) interacting with the guide groove (31) such that said guide groove (31) and said guide protrusion (32) delimit a sliding path of the activation element (7) on the outlet mouthpiece (2).

2. The sanitary unit as claimed in claim 1, wherein the outlet structure (8) is formed by connection webs that are oriented transversely to an outlet direction of the activation element (7).

3. The sanitary unit as claimed in claim 1, wherein the outlet structure (8) is configured as at least one of a honeycomb cell structure, a mesh structure, or a net structure, formed by webs that at least one of mutually intersect at intersection points or are integrally molded to one another, said webs delimiting throughflow openings therebetween.

4. The sanitary unit as claimed in claim 1, wherein the outlet structure (8) is integrally molded to the activation element (7) that serves as the handling element.

5. The sanitary unit as claimed in claim 1, wherein the outlet structure (8) forms an outflow-side end side of the activation element (7).

6. The sanitary unit as claimed in claim 1, wherein the transmission element (9) is integrally molded to an inflow side of the outlet structure (8) and projects counter to a throughflow direction beyond said outlet structure (8).

7. The sanitary unit as claimed in claim 1, wherein the outlet structure (8) comprises a honeycomb structure formed from mutually intersecting webs which delimit honeycomb-shaped throughflow openings.

8. The sanitary unit as claimed in claim 1, wherein the outlet structure (8) comprises a flow rectifier having throughflow openings, and the throughflow openings in a throughflow direction have a height (h) which is larger than a maximum available cross section (W) of the throughflow openings.

9. The sanitary unit as claimed in claim 1, wherein the outlet mouthpiece (2) on an outflow-side end peripheral region on the internal circumference, and the guide internal wall (29) of the activation element (7) on a free end peripheral region thereof on an external circumference interact in each case with one ramp (33, 34) for snap-fitting or latch-fitting, respectively, the guide protrusion (32) in the guide groove (31).

10. The sanitary unit as claimed in claim 1, wherein the functional element (5) is configured as an aerated jet regulator which mixes the water perfusing the insert housing with ambient air.

11. The sanitary unit as claimed in claim 10, wherein the functional unit with the aerated jet regulator has an insert housing, at least one aeration opening (42) for suctioning ambient air into a housing interior being provided on at least one of a housing circumference of said insert housing or on an outflow-side housing end side of said insert housing.

12. The sanitary unit as claimed in claim 1, wherein at least one hole (39) is provided on an outlet end side of the activation element (7).

13. The sanitary unit as claimed in claim 12, wherein at least two holes (39) that are mutually spaced apart in a circumferential direction are provided on the outlet end side of the activation element (7), said holes (39) forming a tool engagement location for a rotating tool (40) that is attachable to the activation element (7) on the outlet end side.

14. The sanitary unit as claimed in claim 1, wherein the transmission element (9) comprises at least one transmission pin.

15. The sanitary unit as claimed in claim 1, wherein the transmission element (9) is guided for axial displacement in a slide guide that is centrally disposed in the functional element (5).

16. The sanitary unit as claimed in claim 1, wherein the activation element (7) is sleeve-shaped, the outlet structure (8) of the activation element (7) is formed by at least two connection webs, said connection webs (8) being connected to the transmission element (9), and the connection webs (8) are distributed spaced apart across an available sleeve opening of the sleeve-shaped activation element (7).

17. The sanitary unit as claimed in claim 16, wherein the transmission element (9) includes a transmission pin, and the connection webs of the outlet structure (8) connect the activation element (7) to the transmission pin and are disposed in a stellar or radial manner.

18. The sanitary unit as claimed in claim 1, wherein the activation element (7) is integrally connected to at least one connection web (8), and the at least one connection web of the outlet structure (8) is integrally connected to a transmission pin of the transmission element (9).

19. The sanitary unit as claimed in claim 1, wherein the component (6) that is adjustable between at least two functional positions is configured as a closure member or valve member which in one of the functional positions thereof closes at least one cleaning opening or valve opening.

20. The sanitary unit as claimed in claim 1, wherein the activation element (7) is configured as a sleeve-shaped activation element (7).

21. A sanitary unit (1, 116, 118), comprising:

a sleeve-shaped outlet mouthpiece (2) that is adapted to be assembled on a water outlet of a sanitary outlet fitting, and has a sleeve interior;

a sanitary functional unit (4) having a functional element (5) inserted in the sleeve interior, said functional element (5) having a component (6) that is adjustable between at least two functional positions;

an externally accessible handling element having a transmission element (9) which is guided so as to be axially displaceable in the functional element (5) for moving the component (6) between the at least two functional positions;

the handling element comprises an activation element (7) which is held so as to be displaceable on an external circumference of a part-region of the outlet mouthpiece (2) that is adapted to project beyond the water outlet of the outlet fitting;

a water-jet-permeable or water-jet-guiding outlet structure (8) connects the activation element (7) to the transmission element (9) is held on the activation element (7);

the functional element (5) is configured as an aerated jet regulator which mixes the water perfusing the insert housing with ambient air;

the functional unit with the aerated jet regulator has an insert housing, at least one aeration opening (42) for suctioning ambient air into a housing interior being provided on at least one of a housing circumference of said insert housing or on an outflow-side housing end side of said insert housing; and the at least one aeration opening (42) in a throughflow direction is disposed ahead of an inflow-side end periphery of the guide internal wall (29) in a sliding terminal position of the activation element (7) that lies counter to the throughflow direction on the housing circumference of the insert housing.

22. A sanitary unit (1, 116, 118), comprising:

a sleeve-shaped outlet mouthpiece (2) that is adapted to be assembled on a water outlet of a sanitary outlet fitting, and has a sleeve interior;

a sanitary functional unit (4) having a functional element (5) inserted in the sleeve interior, said functional element (5) having a component (6) that is adjustable between at least two functional positions;

an externally accessible handling element having a transmission element (9) which is guided so as to be axially displaceable in the functional element (5) for moving the component (6) between the at least two functional positions;

the handling element comprises an activation element (7) which is held so as to be displaceable on an external circumference of a part-region of the outlet mouthpiece (2) that is adapted to project beyond the water outlet of the outlet fitting;

a water-jet-permeable or water-jet-guiding outlet structure (8) connects the activation element (7) to the transmission element (9) is held on the activation element (7);

the activation element (7) is connected to the outlet mouthpiece (2) in a rotationally fixed manner in at least one sliding position that is advanced counter to a throughflow direction; and the outlet mouthpiece (2) at least in one part-region of a longitudinal extent thereof has a shape that in at least one circumferential portion deviates from a circular cross section, and the sleeve-shaped activation element (7) on a sleeve internal circumference thereof in at least one portion of the longitudinal extent thereof has at least one protrusion (38) which in a sliding position of the activation element (7) that is adapted to be advanced counter to the throughflow direction is moveable so as to be congruent with the at least one part-region (37) of the outlet mouthpiece that deviates from the circular cross section.

23. The sanitary unit as claimed in claim 22, wherein at least one anti-rotation protrusion (35) projects on at least one of the outlet mouthpiece (2) or the activation element (7) on an internal circumference or an external circumference, said anti-rotation protrusion (35) in a sliding position that is adapted to be advanced counter to the throughflow direction is introducible into at least one anti-rotation clearance (36) on the respective other of the activation element or the outlet mouthpiece (7, 2).

24. A sanitary unit (1, 116, 118), comprising:

a sleeve-shaped outlet mouthpiece (2) that is adapted to be assembled on a water outlet of a sanitary outlet fitting, and has a sleeve interior;

a sanitary functional unit (4) having a functional element (5) inserted in the sleeve interior, said functional element (5) having a component (6) that is adjustable between at least two functional positions;

an externally accessible handling element having a transmission element (9) which is guided so as to be axially displaceable in the functional element (5) for moving the component (6) between the at least two functional positions;

the handling element comprises an activation element (7) which is held so as to be displaceable on an external circumference of a part-region of the outlet mouthpiece (2) that is adapted to project beyond the water outlet of the outlet fitting;

a water-jet-permeable or water-jet-guiding outlet structure (8) connects the activation element (7) to the transmission element (9) is held on the activation element (7);

the outlet structure (8) includes at least one connection web that at least in a sliding terminal position that faces the water outlet fitting penetrates an assigned elongate hole in the outlet mouthpiece (2); and the at least one connection web of the outlet structure (8) is guided so as to be rotationally secured but displaceable in the elongate hole assigned to said connection web.

25. The sanitary unit as claimed in claim 24, wherein the activation element (7) is held on the outlet mouthpiece (2) so as to be displaceable between the sliding terminal position that faces away from the water outlet in which the activation element (7) is held so as to be rotatable on the outlet mouthpiece (2), and a sliding terminal position that faces the water outlet.

26. The sanitary unit as claimed in claim 25, wherein the at least one elongate hole that is assigned to the connection web is configured so as to be open on an end peripheral side.

27. A sanitary unit (1, 116, 118), comprising:

a sleeve-shaped outlet mouthpiece (2) that is adapted to be assembled on a water outlet of a sanitary outlet fitting, and has a sleeve interior;

a sanitary functional unit (4) having a functional element (5) inserted in the sleeve interior, said functional element (5) having a component (6) that is adjustable between at least two functional positions;

an externally accessible handling element having a transmission element (9) which is guided so as to be axially displaceable in the functional element (5) for moving the component (6) between the at least two functional positions;

the handling element comprises an activation element (7) which is held so as to be displaceable on an external circumference of a part-region of the outlet mouthpiece (2) that is adapted to project beyond the water outlet of the outlet fitting;

a water-jet-permeable or water-jet-guiding outlet structure (8) connects the activation element (7) to the transmission element (9) is held on the activation element (7); and a holding pin (13) molded to the activation element (7), said holding pin (13) engaging in at least one holding clearance (14) on an outflow-side end periphery of the outlet mouthpiece (2) such that the activation element and the outlet mouthpiece are guided so as to be rotationally secured but so as to be axially displaceable in one another.

* * * * *